US009068475B2

(12) United States Patent
Littler et al.

(10) Patent No.: US 9,068,475 B2
(45) Date of Patent: Jun. 30, 2015

(54) STATOR VANE ASSEMBLY

(75) Inventors: Graham Littler, Nottingham (GB); Ian A Hood, Derby (GB)

(73) Assignee: ROLLS-ROYCE plc, London (GB)

( * ) Notice: Subject to any disclaimer, the term of this patent is extended or adjusted under 35 U.S.C. 154(b) by 639 days.

(21) Appl. No.: 13/421,431

(22) Filed: Mar. 15, 2012

(65) Prior Publication Data

US 2012/0257964 A1 Oct. 11, 2012

(30) Foreign Application Priority Data

Apr. 6, 2011 (GB) ..... 1105788.2

(51) Int. Cl.
*F01D 25/24* (2006.01)
*F01D 9/04* (2006.01)

(52) U.S. Cl.
CPC ..... *F01D 25/246* (2013.01); *Y10T 29/49229* (2015.01); *F01D 9/04* (2013.01)

(58) Field of Classification Search
CPC ..... F01D 9/04; F01D 9/042; F01D 25/246; F05D 2240/12; F05D 2240/128; F05D 2230/25
USPC ..... 415/191, 209.2, 209.3, 209.4, 211.2, 415/215.1, 914
See application file for complete search history.

(56) References Cited

U.S. PATENT DOCUMENTS 2,980,396 A * 4/1961 Movsesian ..... 415/189
4,395,195 A * 7/1983 De Cosmo et al. ..... 415/137
5,272,869 A 12/1993 Dawson et al.
5,846,050 A * 12/1998 Schilling ..... 415/135
7,448,851 B2 11/2008 Bolgar et al.
8,398,366 B2 * 3/2013 Twell ..... 415/209.2
2007/0140854 A1 * 6/2007 Conrad ..... 416/193 A

FOREIGN PATENT DOCUMENTS

EP 0 528 520 A1 2/1993
EP 1 219 785 A1 7/2002
GB 2 249 356 A 5/1992
GB 2 327 466 A 1/1999
GB 2 434 182 A 7/2007

OTHER PUBLICATIONS

Aug. 2, 2011 Search Report issued in British Application No. 1105788.2.

* cited by examiner

*Primary Examiner* — Edward Look
*Assistant Examiner* — Jason Davis
(74) *Attorney, Agent, or Firm* — Oliff PLC

(57) ABSTRACT

There is disclosed a stator vane assembly comprising a support structure 14 arranged to be mounted to a mounting structure 16, a stator vane 12 radially extending from the support structure 14 and a continuity member 28 coupled to the support structure 14 and arranged in use to extend between the mounting structure 16 and the support structure 14 so as to provide a substantially continuous gas-washed surface across the mounting structure 16 and the support structure 14. There is also disclosed a method of forming a stator vane assembly, the method comprising the steps of forming at least one stator vane radially extending from a support structure having a continuity member coupled thereto.

15 Claims, 3 Drawing Sheets

STATOR VANE ASSEMBLY

The invention relates to a stator vane assembly. The invention is particularly, although not exclusively, concerned with a stator vane assembly for a gas turbine engine.

A gas turbine engine generally comprises a fan, a compressor, a combustor, and a turbine in axial flow order. The core engine flow passes through flow annuli of the compressor, combustor and turbine. The compressor and turbine have successive stages of rotors and stators which are used to transfer energy to and from the core engine flow.

A stator vane is a non-rotating component of a turbomachine, such as a gas turbine engine, that conditions the core engine flow upstream of a rotor stage of a compressor or a turbine.

A casing structure envelopes the compressor, the combustor and the turbine, and forms the outer radial gas-washed surface of the flow annuli. The stator vanes may be cantilever-mounted to the casing so that they project into the flow annuli between rotor stages.

Figure 1:
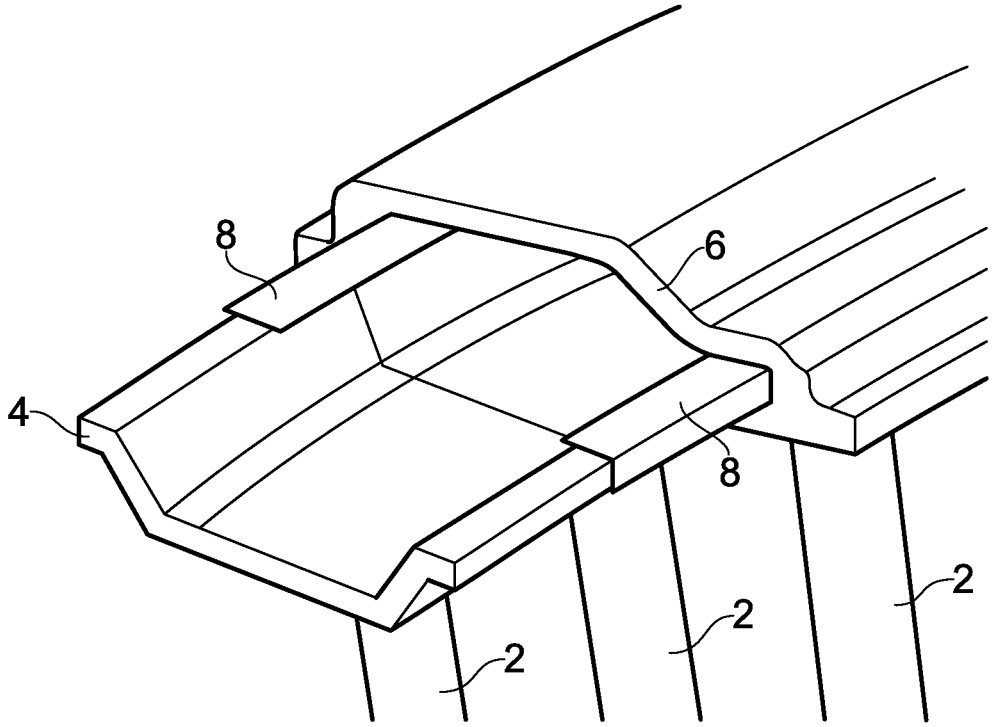
FIG. 1 Prior Art

In a previously considered arrangement shown in FIG. 1, each stator vane 2 is integrally formed with a support section 4. The support section 4 is mounted in the recess of an engine casing 6. Individual anti-fret liners 8 are located over mounting rails of the support section 4 and are positioned between the support section 4 and the casing 6. In use, the anti-fret liners inhibit fret degradation between the support section 4 and the casing 6.

Figure 2:
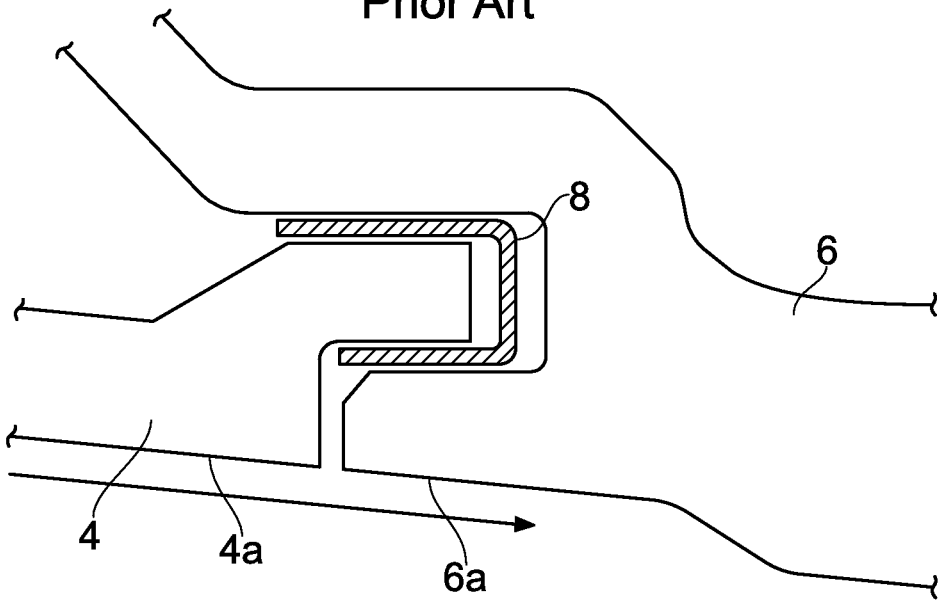
FIG. 2 Prior Art

The individual stator vanes 2 with support sections 4 are manufactured by forging and machining. The support section 4 is formed such that an inner gas-washed surface 4*a* of the support section 4 is substantially flush with the gas-washed surface 6*a* of the casing 6, as shown in FIG. 2. This provides a substantially continuous gas-washed surface 4*a*, 6*a* across the support structure 4 and the casing 6.

It may be important to provide a substantially continuous gas-washed surface so that discontinuities are not introduced into the flow that may lead to pressure and efficiency losses, noise and adverse loading of the components.

Whist this stator vane arrangement is satisfactory, the forging and machining process can be expensive.

It is therefore desirable to provide an improved stator vane assembly that may be less expensive to manufacture.

In a broad aspect the invention relates to a continuity member arranged to provide a substantially continuous gas-washed surface across a support structure of a turbomachine vane or blade and an adjacent structure.

The adjacent structure may be a mounting structure, such as a casing or sealing platform. The adjacent structure may be an upstream or downstream component, for example a rotor shroud or a rotor platform.

According to an aspect of the invention there is provided a stator vane assembly comprising: a support structure arranged to be mounted to a mounting structure; a stator vane radially extending from the support structure; and a continuity member coupled to the support structure and arranged in use to extend between the mounting structure and the support structure so as to provide a substantially continuous gas-washed surface across the mounting structure and the support structure. There may be one or more than one continuity member.

A gas-washed surface is a surface over which the core flow of the working fluid through an engine, such as a gas turbine engine, passes. The phrase "substantially continuous gas-washed surface" means that there are no large radial step changes in the gas-washed surface and there are no large gaps in the gas-washed surface which can disturb core flow.

The mounting structure may have a gas-washed surface. At least a portion of the continuity member may have a gas-washed surface substantially flush with the gas-washed surface of the mounting structure, thereby forming a substantially continuous gas-washed surface across the mounting structure and the support structure.

The mounting structure may have first and second axially spaced gas-washed surfaces. At least a portion of the continuity member may extend between, and be substantially flush with, the first and second gas-washed surfaces of the mounting structure.

The support structure may be mounted to the mounting structure using any known fixing arrangement, for example, a T-slot or a dovetail arrangement.

The support structure may comprise first and second circumferentially extending axially spaced rails arranged to be retained within corresponding first and second channels provided in the mounting structure, and a circumferentially extending platform section, to which the vane is attached, axially extending therebetween.

The continuity member may have at least one end portion disposed between the support structure and the mounting structure.

There may be a plurality of continuity members circumferentially spaced from one another.

The continuity member may have a first portion disposed between the first rail and the first channel and a second portion disposed between the second rail and the second channel, and a central portion extending across the platform section between the first and second portions, thereby providing a substantially continuous gas-washed surface across the mounting structure and the support structure.

The first and second end portions of the continuity member may form an anti-fret layer between the support structure and the mounting structure, thereby inhibiting fret degradation between the support structure and the mounting structure.

The central portion may extend between the first and second gas-washed surfaces of the mounting structure. The platform section may be radially offset from the first and second rails, and there may be first and second transition portions between the first rail and the platform section and the second rail and the platform section respectively, wherein in use there may be first and second gaps between the first and second transition portions and the mounting structure. The continuity member may extend across the first and second gaps, thereby providing a substantially continuous gas-washed surface across the mounting structure and the support structure.

A separate anti-fret layer may be provided that is not part of the continuity member.

The stator vane may have a tang portion at a radial end of a vane portion, the tang portion passing through a tang opening in the support structure and deformed so as to secure the stator vane to the support structure. The tang portion may have a smaller cross-section than the vane portion.

The tang portion may be deformed by hot-upset forging. The hot-upsetting may compress the tang portion, thereby widening the cross-section of a protruding end of the tang portion such that it may not be withdrawn from the tang opening.

The tang opening in the support structure may be formed using a cutting process, for example a laser cutting process. The cross section of the tang portion and tang opening may be complimentary with one another and arranged to inhibit rotation of the stator vane.

The tang may pass through a tang opening in the continuity member, thereby attaching the continuity member to the support structure.

The support structure may be manufactured by roll forming.

The support structure may have at least one void, the inner opening of which is covered by the continuity member. The void may be a weight-saving cut-out in the support structure.

The stator vane assembly may be a banded stator vane assembly comprising a plurality of stator vanes radially extending from a circumferentially extending support structure. The continuity member may be coextensive with the support structure. The banded stator vane assembly may form at least an arc portion of an annular stator vane assembly, for example, a 45° portion.

The continuity member may circumferentially extend to form an arc portion greater than the arc portion of the support structure of the stator vane assembly.

The support structure may be provided at the radial outer end of the stator vane. The mounting structure may be a casing.

The support structure may be provided at the radial inner end of the stator vane. The mounting structure may be a sealing platform at the radial inner end of the stator vane and support structure, which may provide a seal with a rotating component.

The stator vane may be a turbine stator vane or a compressor stator vane.

The invention also concerns a gas turbine engine comprising a mounting structure and a stator vane assembly in accordance with any statement herein, wherein the support structure is mounted to the mounting structure.

According to a second aspect of the invention, there is provided a method of forming a stator vane assembly in accordance with any statement herein, comprising forming at least one stator vane radially extending from a support structure having a continuity member coupled thereto.

The support structure may be formed by roll forming.

The method may further comprise forming a tang opening in the support structure and a tang opening in the continuity member; passing a tang portion of the at least one stator vane through the tang openings in the support structure and continuity member; and deforming the tang portion to attach the stator vane to the support structure and continuity member. The tang portion may be deformed by hot-upset forging.

The method may comprise attaching a plurality of vanes to the support structure.

According to a further aspect of the invention there is provided a blade assembly comprising: a stator vane or rotor blade; a support structure provided at a radial end of the stator vane or rotor blade; and a continuity member arranged in use to extend between the support structure and an adjacent structure so as to provide a substantially continuous gas-washed surface across the support structure and the adjacent structure.

The adjacent structure may be a mounting structure, such as a casing or sealing platform. The adjacent structure may be an upstream or downstream component, for example a rotor shroud or platform.

The support structure may be at the inner or outer radial end of the stator vane or rotor blade.

The invention may comprise any combination of the features and/or limitations referred to herein, except combinations of such features as are mutually exclusive.

Figure 3:
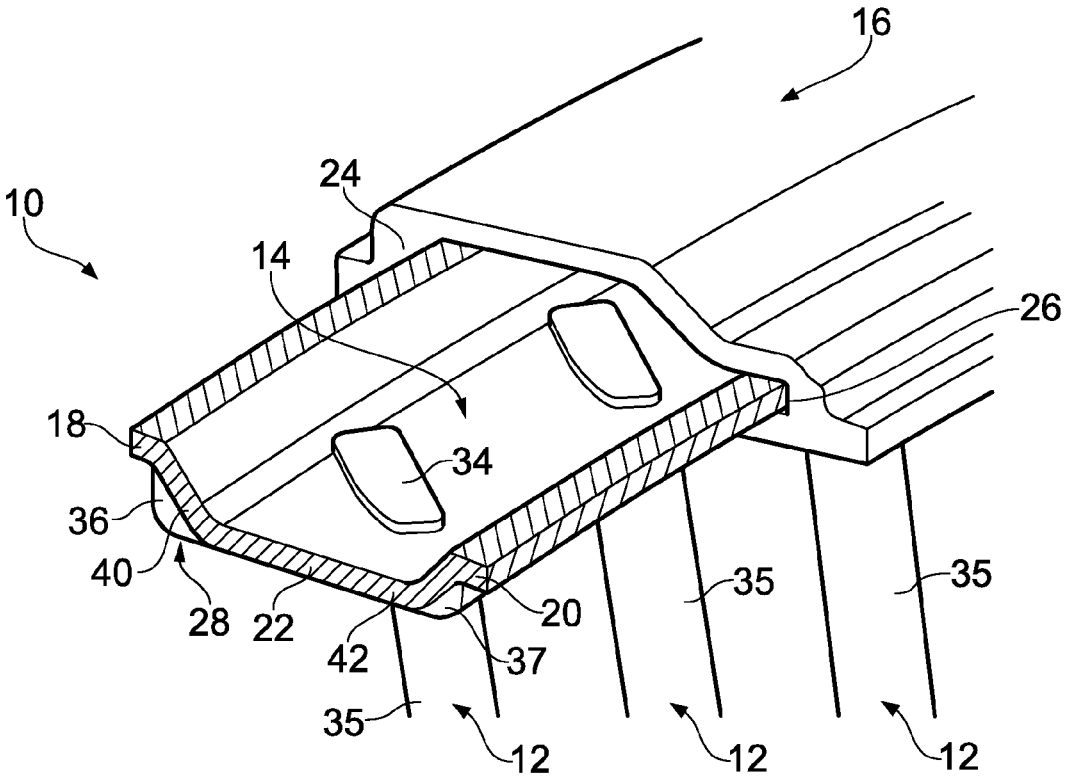
Figure 4:
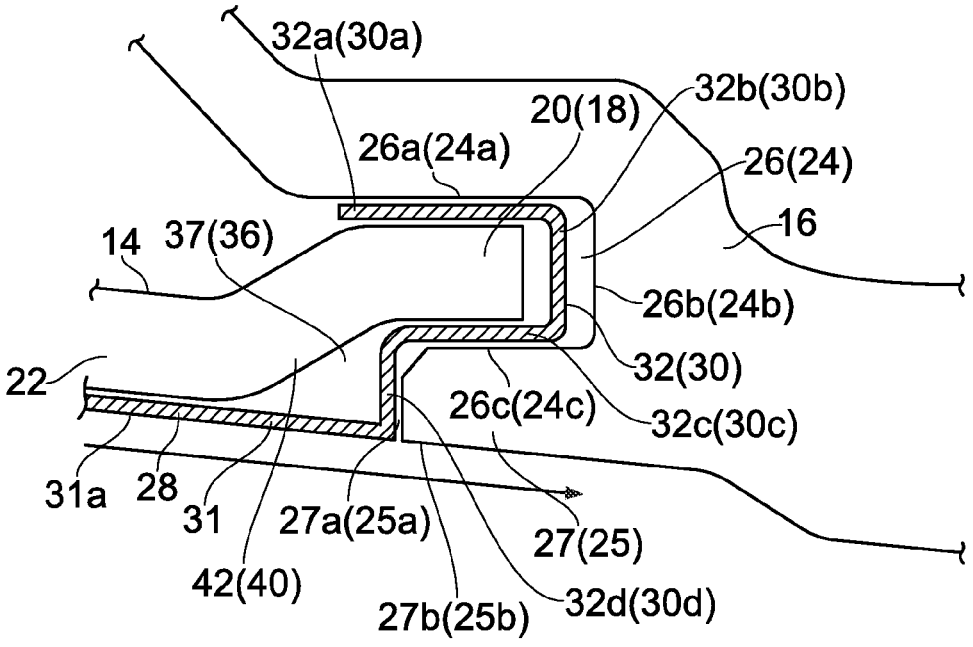
Figure 5:
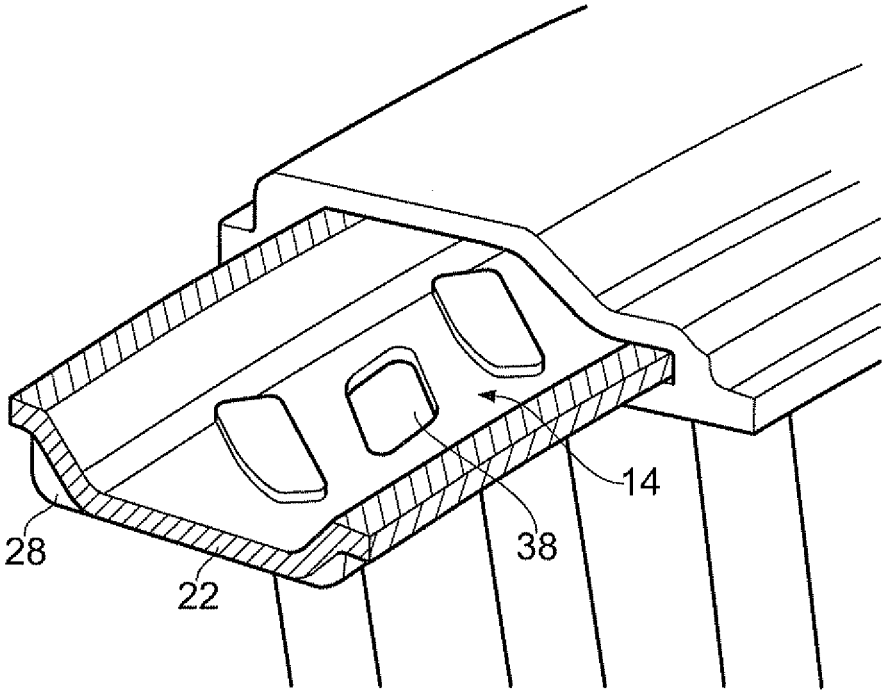
Figure 6:
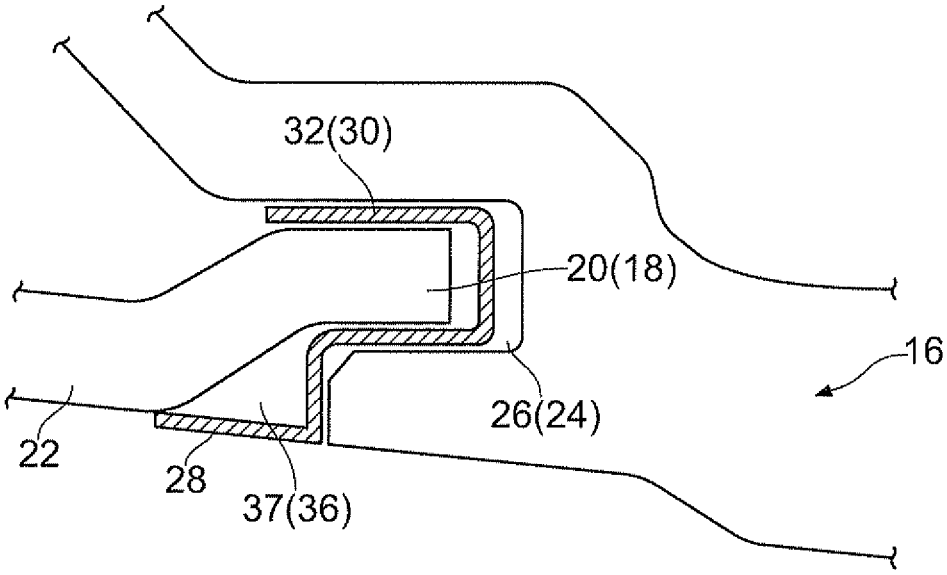

Embodiments of the invention will now be described, by way of example, with reference to the accompanying drawings, in which:

FIG. 1 schematically shows a portion of a previously considered stator vane assembly;

FIG. 2 schematically shows a cross-sectional view of a portion of the stator vane assembly of FIG. 1;

FIG. 3 schematically shows a first embodiment of a stator vane assembly mounted to an engine casing;

FIG. 4 schematically shows a cross-sectional view of the stator vane assembly of FIG. 3;

FIG. 5 schematically shows a second embodiment of a stator vane assembly mounted to an engine casing; and FIG. 6 schematically shows a cross-sectional view of a third embodiment of a stator vane assembly.

FIGS. 3 and 4 show an embodiment of a banded stator vane assembly 10 comprising a plurality of stator vanes 12 circumferentially spaced and radially inwardly extending from a circumferentially extending support structure 14, and a continuity member 28. The support structure 14 may therefore be referred to as an outer band. The banded stator vane assembly 10 is attached and mounted to a mounting structure 16 which is this particular embodiment is the engine casing of a gas turbine engine.

In this embodiment the banded stator vane assembly 10 is an arc portion of a complete stator vane assembly annulus. For example, the banded stator vane assembly 10 may be a 45° arc portion and there may be a total of eight identical banded stator vane assemblies 10 forming a complete annulus.

The support structure 14 has a substantially constant cross-section in a radially extending plane. The support structure 14 comprises first and second axially spaced rails 18, 20, and a platform section 22 axially extending therebetween. The first and second rails 18, 20 are at the same radial position and the platform section 22 is radially offset inwardly of the first and second rails 18, 20. There are first and second transition portions 40, 42 disposed between the first and second rails 18, 20 and the platform section 22 respectively. The transition portions 40, 42 have a curvature that forms the transition between the outer radial position of the rails 18, 20 and the platform section 22.

The continuity member 28 is circumferentially extending and in this embodiment is coextensive with the support structure 14. The continuity member 28 is disposed on the radial inner side of the support structure 14 and extends from the first rail 18 to the second rail 20. The continuity member 28 comprises a first end portion 30 that is located over the first rail 18 of the support structure 14 and a second end portion 32 that is located over the second rail 20 of the support structure 14. A central portion 31 extends between the first and second end portions 30, 32. Each of the end portions 30, 32 comprises an axially extending upper portion 30*a*, 32*a*, a radially extending side portion 30*b*, 32*b*, an axially extending lower portion 30*c*, 32*c* and a radially extending step portion 30*d*, 32*d*. The upper portion 30*a*, 32*a* is located over the upper surface of each rail 18, 20, the side portion 30*b*, 32*b* is located over the end of each rail 18, 20 and the lower portion 30*c*, 32*c* is located over the lower surface of each rail 18, 20. The step portion 30*d*, 32*d* connects the lower portion 30*c*, 32*c* to the central portion 31. The central portion 31 extends across the radial inner surface of the platform section 22 and the first and second transition portions 40, 42 of the support structure 14.

The continuity member 28 is permanently attached to the support structure 14 and the stator vanes 12 by a hot-upset forging process that will be described in detail below.

The engine casing 16 is provided with first and second circumferentially extending and axially spaced channels 24, 26 that correspond to the first and second rails 18, 20. The first and second channels 24, 26 each form a complete annulus when the engine is fully assembled. Each of the channels 24, 26 has an upper wall 24*a*, 26*a*, a side wall 24*b*, 26*b*, a lower wall 24*c*, 26*c* and an annular opening that lies in a radially extending plane. The openings of the first and second channels 24, 26 face one another. The lower wall 24*c*, 26*c* of each of the channels 24, 26 is formed by first and second axially projecting lip portions 25, 27. The first and second lip portions 25, 27 also provide first and second lip ends 25*a*, 27*a*, and first and second gas-washed surfaces 25*b*, 27*b*. In use, the first and second gas-washed surface 25*b*, 27*b* are exposed to the engine core flow.

When the engine is assembled, the first and second rails 18, 20 of the support structure 14 are located in the first and second channels 24, 26 of the engine casing respectively. The first and second end portions 30, 32 of the continuity member 28 are disposed between the first and second rails 18, 20 and the first and second channels 24, 26. In particular, the upper portion 30*a*, 32*a* is disposed between the upper surface of the rail 18, 20 and the upper wall 24*a*, 26*a* of the channel 24, 26; the side portion 30*b*, 32*b* is disposed between the end of the rail 18, 20 and the side wall 24*b*, 26*b* of the channel 18, 20; and the lower portion 30*c*, 32*c* is disposed between the lower surface of the rail 18, and the lower wall 24*c*, 26*c* of the channel 18, 20. The step portions 30*d*, 32*d* of the continuity member 28 are adjacent to and abut the respective lip ends 25*a*, 27*a* of the casing 16 and extend over the radial thickness of the lip 25, 27. A central portion 31 of the continuity member 28 is substantially in contact with the platform section 22. The central portion 31 of the continuity member 28 extends between the first and second step portions 30*d*, 32*d* and is substantially flush with the first and second gas-washed surfaces 25*b*, 27*b* of the engine casing 16. The radial inner surface 31*a* of the central portion 31 therefore also provides a gas-washed surface. Importantly, since the central portion 31 of the continuity member 28 is adjacent to the first and second gas-washed surfaces 25*b*, 27*b* of the casing 16 and is flush with them, a substantially continuous gas-washed surface is provided across the engine casing 16 and the support structure 14. In other words, there are no large gaps or step changes in the gas-washed surface.

In this particular embodiment, first and second gaps 36, 37 are present between the first and second lips 25, 27 of the casing 16 and first and second transition regions 40, 42. However, since the central portion 31 of the continuity member 28 extends over these gaps, no large step changes or gaps in the gas-washed surface are present. This provides a substantially continuous gas-washed surface.

The first and second end portions 30, 32 of the continuity member 28 disposed between the first and second rails 18, 20 and the first and second channels 24, 26 respectively serve as anti-fret liners. They therefore inhibit fret degradation between the support structure 14 and casing 16.

The banded stator vane assembly 10 may be formed as follows.

Individual stator vanes 12 are formed that each include a tang portion 34 at a radially outer end of a vane portion 35. The stator vanes 12 are integrally formed by forging and machining. The circumferentially extending support structure 14 is manufactured by roll-forming a sheet of material The roll-forming process forms the first and second rails 18, 20, the platform section 22 and the first and second transition regions 40, 42. Each of the transition regions 40, 42 must have a minimum bending radius in order to avoid residual stresses which may be imparted on the material which would increase the risk of cracking or would otherwise reduce the life or strength of the support structure 14. The continuity member 28 is formed from a layer of pressed sheet material to integrally form the first and second end portions 30, 32 and the central portion 31. A plurality of circumferentially spaced tang openings (not shown) are formed in the platform section 22 of the support structure 14 and in the central portion 31 of the continuity member 28. The number of tang openings corresponds to the number of stator vanes 12 to be attached to the support structure 14. The tang openings may be formed by a laser-cutting process.

After forming the support structure 14 and the continuity member 28, the continuity member 28 is coupled to the support structure 14 by sliding the rails 18, 20 into the first and second end portions 30, 32. The support structure 14 and continuity member 28 are coupled together such that the tang openings are aligned. In this embodiment, the continuity member 28 is coextensive with the support structure 14. However, in other embodiments the circumferential length of the continuity member 28 may be greater or less than that of the support structure 14.

The tang portion 34 of each stator vane 12 is passed through the aligned tang openings in the continuity member 28 and the support structure 14 from the radially inner side. The tang portion 34 is then permanently deformed on the radially outer side of the support structure 14 by hot-upset forging such that the stator vane 12 is secured to the support structure 14 and the continuity member 28. This process also permanently attaches the continuity member 28 to the support structure 14.

The provision of the continuity member 28 allows the support structure 14 to be formed by roll forming and provides a substantially continuous gas-washed surface across the casing 16 and the support structure 14. In particular, the continuity member 28 extends across the gaps 36, 37 present between the casing 16 and the transition regions 40, 42 that are inherently formed due to the roll-forming process. The roll forming process is significantly less expensive than the forging and machining process conventionally used to manufacture an outer radial band. Therefore, the overall cost of the stator vane assembly 10 can be reduced.

FIG. 5 shows a stator vane assembly 10 in accordance with a second embodiment of the invention. The second embodiment differs from the first embodiment in that the support structure 14 has a weight-saving cut-out 38 in the platform section 22 that may be formed by a laser-cutting process. The continuity member 28 entirely covers the radially inner side of the cut-out 38 and therefore prevents any gas flow through the cut-out. Where mechanical loading allows, weight saving cut-outs 38 may be created in the support structure 14 to reduce the overall weight of the assembly.

FIG. 6 shows a stator vane assembly 10 in accordance with a third embodiment of the invention. The third embodiment differs from the first embodiment in that there are first and second continuity members 28, one at each axial end of the platform section 22. An end portion 30, 32 of each continuity member 28 is disposed between the respective rail 18, 20 and channel 24, 26. Unlike the first embodiment, there is no central portion extending entirely across the platform section 22 of the support structure. Nevertheless, a portion of each continuity member 28 extends across the gap 36, 37 formed between the transition regions 40, 42 and the engine casing 16, thereby providing a substantially continuous gas-washed surface across the casing 16 and the support structure 14. However, the difference in this embodiment is that the platform section 22 of the support structure 14 forms part of the gas-washed surface.

Although it has been described that the vanes are stator vanes, it should be appreciated that the vanes could be turbine vanes, for example. Further, the support structure may be a radial inner band as opposed to a radial outer band and it is not essential that the stator assembly is a banded stator assembly.

The invention claimed is:

1. A stator vane assembly, comprising:

a support structure arranged to be mounted to a mounting structure and having first and second circumferentially extending axially spaced rails arranged to be retained within corresponding first and second channels provided in the mounting structure and a circumferentially extending platform section axially extending therebetween;

a stator vane radially extending from the platform section; and a continuity member coupled to the support structure and having a first portion disposed between the first rail and the first channel and a second portion disposed between the second rail and the second channel, and a central portion extending across and substantially in contact with the platform section between the first and second portions, thereby providing a substantially continuous gas-washed surface across the mounting structure and the support structure.

2. The stator vane assembly according to claim 1, wherein the mounting structure has a gas-washed surface, and wherein at least a portion of the continuity member has a gas-washed surface substantially flush with the gas-washed surface of the mounting structure, thereby forming a substantially continuous gas-washed surface across the mounting structure and the support structure.

3. The stator vane assembly according to claim 1, wherein the mounting structure has first and second axially spaced gas-washed surfaces, and wherein at least a portion of the continuity member extends between, and is substantially flush with, the first and second gas-washed surfaces of the mounting structure.

4. The stator vane assembly according to claim 1, wherein the first and second portions of the continuity member form an anti-fret layer between the support structure and the mounting structure, thereby inhibiting fret degradation between the support structure and the mounting structure.

5. The stator vane assembly according to claim 1, wherein the platform section is radially offset from the first and second rails, and wherein there are first and second transition portions between the first rail and the platform section and the second rail and the platform section respectively, wherein in use there are first and second gaps between the first and second transition portions and the mounting structure, and wherein the continuity member is arranged in use to extend across the first and second gaps, thereby providing a substantially continuous gas-washed surface across the mounting structure and the support structure.

6. The stator vane assembly according to claim 1, wherein the stator vane has a tang portion at a radial end of a vane portion, the tang portion passing through a tang opening in the support structure and deformed so as to secure the stator vane to the support structure.

7. The stator vane assembly according to claim 6, wherein the tang portion passes through a tang opening in the continuity member, thereby attaching the continuity member to the support structure.

8. The stator vane assembly according to claim 1, wherein the stator vane assembly is a banded stator vane assembly comprising a plurality of stator vanes radially extending from a circumferentially extending support structure, and wherein the continuity member is coextensive with the support structure.

9. The stator vane assembly according to claim 1, wherein the support structure is provided at the outer radial end of the stator vane.

10. The stator vane assembly according to claim 1, wherein the mounting structure is an engine casing and the stator vane is a turbine stator vane or a compressor stator vane.

11. A gas turbine engine comprising a mounting structure and the stator vane assembly in accordance with claim 1, wherein the support structure is mounted to the mounting structure.

12. A method of forming the stator vane assembly according to claim 1, comprising forming at least one stator vane radially extending from a support structure having a continuity member coupled thereto.

13. The method according to claim 12, further comprising the steps of:

forming a tang opening in the support structure and a tang opening in the continuity member;

passing a tang portion of the at least one stator vane through tang opening in the support structure and the continuity member; and deforming the tang portion so as to attach the stator vane to the support structure and continuity member.

14. The method according to claim 13, wherein the tang portion is deformed by hot-upset forging.

15. The stator according to claim 13, further comprising attaching a plurality of vanes to a support structure.

* * * * *